US007591087B2

(12) United States Patent
Kost et al.

(10) Patent No.: US 7,591,087 B2
(45) Date of Patent: Sep. 22, 2009

(54) FLOW DIVIDER FOR SNOWPLOW WINGS

(75) Inventors: James A. Kost, Willoughby, OH (US); Robert L. Potak, Strongsville, OH (US)

(73) Assignee: Louis Berkman Winter Products Company, Cleveland, OH (US)

( * ) Notice: Subject to any disclaimer, the term of this patent is extended or adjusted under 35 U.S.C. 154(b) by 42 days.

(21) Appl. No.: 11/858,953

(22) Filed: Sep. 21, 2007

(65) Prior Publication Data

US 2008/0072463 A1 Mar. 27, 2008

Related U.S. Application Data

(60) Provisional application No. 60/826,449, filed on Sep. 21, 2006.

(51) Int. Cl.
*E01H 5/06* (2006.01)
*E01H 5/04* (2006.01)

(52) U.S. Cl. ..... 37/281; 37/234

(58) Field of Classification Search ..... 37/232, 37/231, 241, 234, 266, 269, 279, 272, 274, 37/281–283; 172/3–7, 782, 786, 684.5, 815, 172/816

See application file for complete search history.

(56) References Cited

U.S. PATENT DOCUMENTS 2,556,592 A * 6/1951 Markkula ..... 414/704
3,250,026 A * 5/1966 Jocher et al. ..... 37/232
4,306,362 A * 12/1981 Waterman ..... 37/219
4,356,645 A 11/1982 Hine et al.
5,285,588 A 2/1994 Niemela et al.
5,638,618 A * 6/1997 Niemela et al. ..... 37/281
6,035,944 A * 3/2000 Neuner et al. ..... 172/818
6,154,986 A * 12/2000 Hadler et al. ..... 37/234
6,412,199 B1 * 7/2002 Quenzi et al. ..... 37/281
6,467,553 B1 10/2002 Wojanis
6,691,435 B1 2/2004 Schultz et al.

OTHER PUBLICATIONS

Document titled, "HydraForce Flow Control Valves—Flow Divider/Combiner," dated Apr. 20, 2005, printed from web page www.hydraforce.com/flowcont/Fcfdcomb.htm.
Feature Article of 2004 titled, "The Rotary Flow Divider—Waiting to be Discover," printed from web page www.inmotiononline.com.
Schematic page titled, "Basic Hydraulic Open Center Flow Divider System Schematic," printed from web page www.engineersedge.com.

* cited by examiner

*Primary Examiner*—Robert E Pezzuto
(74) *Attorney, Agent, or Firm*—Emerson, Thompson, Bennett; Roger Emerson; Timothy Bennett

(57) ABSTRACT

A snowplow assembly may include a snowplow mechanism having a frame and a pair of wings that are adapted to move independently. The snowplow assembly may also include a hydraulic system that has a first cylinder for use in moving the first wing, a second cylinder for use in moving the second wing, a pump system for use in providing hydraulic fluid to the first and second cylinders, and a flow divider that causes the first wing and the second wing to move at substantially the same time and substantially the same speed regardless of the disparity of loads on the first and second wings.

13 Claims, 7 Drawing Sheets

FLOW DIVIDER FOR SNOWPLOW WINGS

This application claims priority to U.S. Ser. No. 60/826,449, titled FLOW DIVIDER FOR SNOWPLOW WINGS, filed Sep. 21, 2006, which is incorporated herein by reference.

I. BACKGROUND OF THE INVENTION

A. Field of Invention

This invention pertains to the art of methods and apparatuses for snowplows and more specifically to a hydraulic system that can move two snowplow wings at substantially the same time and substantially the same speed regardless of the disparity of loads on the wings.

B. Description of the Related Art

It is well known in the art to provide snowplow assemblies for use in moving snow from roads, driveways, parking lots and other such surfaces. Typically, the snowplow assembly is attached to a vehicle, such as a pickup truck. Usually, the snowplow assembly can be moved by the driver/operator of the vehicle. Thus, for example, the operator can adjust a controller from inside the occupant compartment of the vehicle to raise, lower and pivot the snowplow assembly.

In recent years, the snowplow industry has provided additional snowplow assembly designs and movement options. A relatively new snowplow assembly, for example, is termed a V-plow. A V-plow is essentially two snowplow blades combined onto a single frame. In this case, each snowplow blade is generally considered a wing and typically, each wing can be controlled independently of the other wing. Another known type of snowplow assembly includes a snowplow blade that has a non-pivotal middle portion and two wings. Each pivotal wing is placed on one end of the snowplow's middle portion. As with the V-plow, it is common that each pivotal wing can be controlled independent of the opposite wing.

It is known to move a snowplow assembly using a hydraulic system. As a result, hydraulic components such as hydraulic cylinders, hydraulic piping and hoses, appropriate fittings and the like are required to operate the snowplow assembly. The hydraulic system also generally includes a control mechanism. Typically, the operator manipulates a handle, switches, or buttons on the controller that causes the controller to transmit a corresponding signal to the control mechanism. The control mechanism receives the signal from the controller and then controls the components of the hydraulic system so that the flow of hydraulic fluid is directed appropriately to cause the proper movement of the snowplow assembly. Such control mechanisms are known to include a base plate, a hydraulic reservoir or tank, a hydraulic pump unit, and the necessary control valves such as solenoid valves and/or cartridge valves.

Although known snowplow assemblies having at least two wings work well for their intended purpose, they have several disadvantages. Often, the load acting on one wing of a snowplow assembly may be substantially different from the load acting on the other wing. Referring now to FIG. 1, this disparity in loads acting on each wing may occur, for one non-limiting example, when the operator is plowing snow to the side of the road (with the first wing 34 in a position relatively perpendicular to the road's longitudinal axis and the second wing 36 pivoted in direction D toward the vehicle) and desires to adjust the wings into what is known as scoop mode. Scoop mode is the condition where both wings are pivoted fully forward. More specifically, scoop mode is accomplished when the first wing 34 is pivoted fully in direction A and the second wing 36 is pivoted fully in direction C. Typically, the load (created by the amount of snow or ice in front of the wings) is not the same for both wings. As a result, with all known snowplow assemblies such an adjustment into scoop mode means that the wing with the lesser load will move first and the wing with the greater load will move only after a delay. More specifically, with all known snowplow assemblies adjustment into scoop mode means that the first hydraulic cylinder pivoting the lesser loaded wing will begin moving quickly but the second hydraulic cylinder pivoting the greater loaded wing will only begin moving when the hydraulic pressure in the hydraulic piping to the first cylinder equals the hydraulic pressure in the hydraulic piping to the second cylinder. Such delayed and uneven movement of the wings is undesirable as it waists time and may cause some snow to be left behind (not plowed).

The present invention minimizes this difficulty by providing a flow divider that enables two or more snowplow wings to move at substantially the same time and substantially the same speed regardless of the disparity of loads acting on the wings.

II. SUMMARY OF THE INVENTION

According to one embodiment of this invention, a snowplow assembly may have a snowplow mechanism, a hydraulic system, and a control system. The snowplow mechanism may have a frame and a first wing and a second wing that are adapted to move independently with respect to the frame. The hydraulic system may have a first cylinder for use in moving the first wing, a second cylinder for use in moving the second wing, a pump system for use in providing hydraulic fluid to the first and second cylinders, and a flow divider that causes the first wing and the second wing to move at substantially the same time and substantially the same speed regardless of the disparity of loads on the first wing and the second wing.

According to another embodiment of this invention, a snowplow assembly may have a snowplow mechanism, a hydraulic system, and a control system. The snowplow mechanism may have a frame and a first wing and a second wing that are adapted to move independently with respect to the frame. The hydraulic system may have a first cylinder for use in moving the first wing, a second cylinder for use in moving the second wing, a pump system for use in providing hydraulic fluid to the first and second cylinders, and a flow divider that causes the first wing and the second wing to move at substantially the same time and substantially the same speed regardless of the disparity of loads on the first wing and the second wing. The flow divider may receive hydraulic fluid from the pump system and may provide a first hydraulic stream having a first flow rate to the first cylinder and a second hydraulic stream having a second flow rate to the second cylinder. The first flow rate may be substantially the same as the second flow rate.

According to another embodiment of this invention, a snowplow assembly may have a snowplow mechanism, a hydraulic system, and a control system. The snowplow mechanism may have a frame and a first wing and a second wing that are adapted to pivot independently with respect to the frame. The hydraulic system may have a first cylinder for use in moving the first wing, a second cylinder for use in moving the second wing, a pump system for use in providing hydraulic fluid to the first and second cylinders, and a flow divider that causes the first wing and the second wing to move at substantially the same time and substantially the same speed regardless of the disparity of loads on the first wing and the second wing.

According to one embodiment of this invention, a snowplow assembly may have a snowplow mechanism, a hydraulic system, and a control system. The snowplow mechanism may have a frame and a first wing and a second wing that are adapted to move independently with respect to the frame. The hydraulic system may have a first cylinder for use in moving the first wing, a second cylinder for use in moving the second wing, a pump system for use in providing hydraulic fluid to the first and second cylinders, and a restrictive flow divider that causes the first wing and the second wing to move at substantially the same time and substantially the same speed regardless of the disparity of loads on the first wing and the second wing.

According to one embodiment of this invention, a snowplow assembly may have a snowplow mechanism, a hydraulic system, and a control system. The snowplow mechanism may have a frame and a first wing and a second wing that are adapted to move independently with respect to the frame. The hydraulic system may have a first cylinder for use in moving the first wing, a second cylinder for use in moving the second wing, a pump system for use in providing hydraulic fluid to the first and second cylinders, and a rotary flow divider that causes the first wing and the second wing to move at substantially the same time and substantially the same speed regardless of the disparity of loads on the first wing and the second wing.

According to another embodiment of this invention, a snowplow assembly may have a snowplow mechanism, a hydraulic system, and a control system. The snowplow mechanism may have a frame and a first wing and a second wing that are adapted to move independently with respect to the frame. The hydraulic system may have a first cylinder for use in moving the first wing, a second cylinder for use in moving the second wing, a pump system for use in providing hydraulic fluid to the first and second cylinders, and a flow divider that causes the first wing and the second wing to move at substantially the same time and substantially the same speed regardless of the disparity of loads on the first wing and the second wing. The control system may comprise a control device and a control device position for moving the first wing and the second wing to move at substantially the same time and substantially the same speed.

According to another embodiment of this invention, a snowplow assembly may have a snowplow mechanism, a hydraulic system, and a control system. The snowplow mechanism may have a frame and a first wing and a second wing that are adapted to move independently with respect to the frame. The hydraulic system may have a first cylinder for use in moving the first wing, a second cylinder for use in moving the second wing, a pump system for use in providing hydraulic fluid to the first and second cylinders, and a flow divider that causes the first wing and the second wing to move at substantially the same time and substantially the same speed regardless of the disparity of loads on the first wing and the second wing. The control system may comprise a lever and a control device position for moving the first wing and the second wing to move at substantially the same time and substantially the same speed.

According to another embodiment of this invention, a snowplow assembly may have a snowplow mechanism, a hydraulic system, and a control system. The snowplow mechanism may have a frame and a first wing and a second wing that are adapted to move independently with respect to the frame. The hydraulic system may have a first cylinder for use in moving the first wing, a second cylinder for use in moving the second wing, a pump system for use in providing hydraulic fluid to the first and second cylinders, and a flow divider that causes the first wing and the second wing to move at substantially the same time and substantially the same speed regardless of the disparity of loads on the first wing and the second wing. The control system may comprise a switch and a control device position for moving the first wing and the second wing to move at substantially the same time and substantially the same speed.

According to another embodiment of this invention, a snowplow assembly may have a snowplow mechanism, a hydraulic system, and a control system. The snowplow mechanism may have a frame and a first wing and a second wing that are adapted to move independently with respect to the frame. The hydraulic system may have a first cylinder for use in moving the first wing, a second cylinder for use in moving the second wing, a pump system for use in providing hydraulic fluid to the first and second cylinders, and a flow divider that causes the first wing and the second wing to move at substantially the same time and substantially the same speed regardless of the disparity of loads on the first wing and the second wing. The control system may comprise a plurality of control devices and a plurality of control device positions for moving the first wing and the second wing to move at substantially the same time and substantially the same speed.

According to one embodiment of this invention, a method may include the steps of: providing a snowplow mechanism having a frame, a first wing, and a second wing, wherein the first wing and the second wing are adapted to move independently with respect to the frame; providing a hydraulic system having a first cylinder for use in moving the first wing, a second cylinder for use in moving the second wing, a pump system for use in providing hydraulic fluid to the first and second cylinders, and a flow divider; applying a first load to the first wing; applying a second load, that is greater than the first load, to the second wing; and, moving the first wing and the second wing at substantially the same time and substantially the same speed.

According to another embodiment of this invention, a method may include the steps of: providing a snowplow mechanism having a frame, a first wing, and a second wing, wherein the first wing and the second wing are adapted to move independently with respect to the frame; providing a hydraulic system having a first cylinder for use in moving the first wing, a second cylinder for use in moving the second wing, a pump system for use in providing hydraulic fluid to the first and second cylinders, and a flow divider; applying a first load to the first wing; applying a second load, that is greater than the first load, to the second wing; and, pivoting the first wing and the second wing at substantially the same time and substantially the same speed.

According to another embodiment of this invention, a method may include the steps of: providing a snowplow mechanism having a frame, a first wing, and a second wing, wherein the first wing and the second wing are adapted to move independently with respect to the frame; providing a hydraulic system having a first cylinder for use in moving the first wing, a second cylinder for use in moving the second wing, a pump system for use in providing hydraulic fluid to the first and second cylinders, and a flow divider; applying a first load to the first wing; applying a second load, that is greater than the first load, to the second wing; and, moving the first wing and the second wing at substantially the same time and substantially the same speed. The first wing and the second wing may be moved at substantially the same time and substantially the same speed by communicating hydraulic fluid from the pump system to the fluid divider; communicating a first hydraulic stream having a first flow rate from the fluid divider to the first cylinder; and, communicating a second hydraulic stream having a second flow rate from the fluid divider to the second cylinder. The first flow rate may be substantially the same as the second flow rate.

According to another embodiment of this invention, a method may include the steps of: providing a snowplow mechanism having a frame, a first wing, and a second wing, wherein the first wing and the second wing are adapted to move independently with respect to the frame; providing a hydraulic system having a first cylinder for use in moving fie first wing, a second cylinder for use in moving the second wing, a pump system for use in providing hydraulic fluid to the first and second cylinders, and a flow divider; applying a first load to the first wing; applying a second load, that is greater than the first load, to the second wing; and, moving the first wing and the second wing at substantially the same time and substantially the same speed. The first wing and the second wing may be moved at substantially the same time and substantially the same speed by providing a control system that may have a control device; positioning the control device into a control device position for moving the first wing and the second wing at substantially the same time and substantially the same speed; communicating hydraulic fluid from the pump system to the fluid divider; communicating a first hydraulic stream having a first flow rate from the fluid divider to the first cylinder; and, communicating a second hydraulic stream having a second flow rate from the fluid divider to the second cylinder. The first flow rate may be substantially the same as the second flow rate.

One advantage of this invention is that known delayed and uneven movement of snowplow wings when under differing loads is eliminated Another advantage of this invention is that known hydraulic systems utilized in snowplow mechanisms having at least two wings can be easily modified to accommodate the flow divider.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
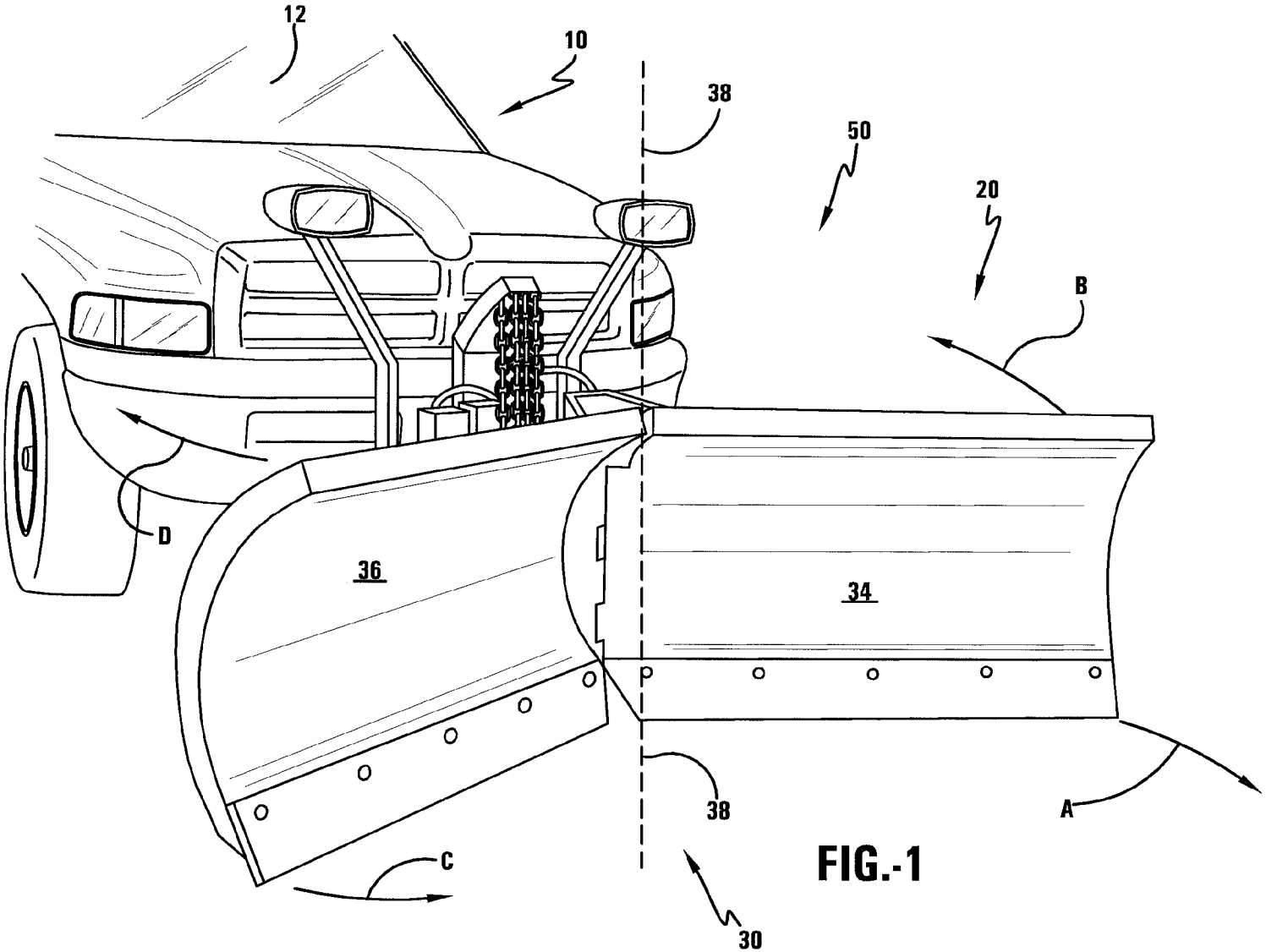
FIG. 1 is a perspective front view of a vehicle equipped with a snowplow assembly according to this invention.
Figure 2:
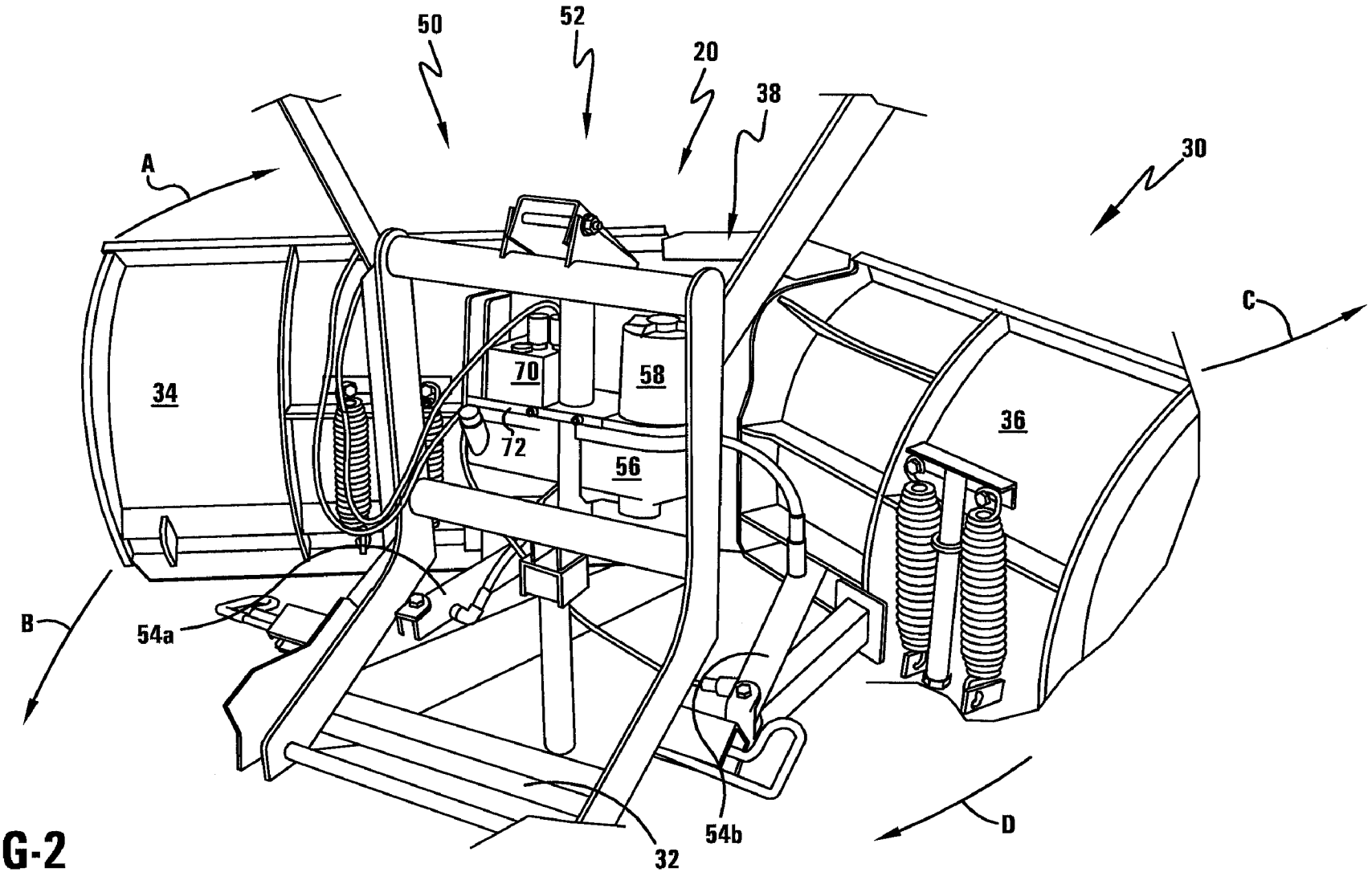
FIG. 2 is a perspective back view of the snowplow assembly of FIG. 1 shown detached from the vehicle.

Referring now to the drawings wherein the showings are for purposes of illustrating embodiments of the invention only and not for purposes of limiting the same, FIG. 1 shows a snowplow assembly 20, attached to a vehicle 10 according to one embodiment of this invention. The vehicle 10 may include an occupant compartment 12 from where an operator may operate the snowplow assembly 20. With reference to FIGS. 1 and 2, the snowplow assembly 20 may include a snowplow mechanism 30, a hydraulic system 50, and a control system 140 that may enable the movement, for example the raising and lowering, of the snowplow mechanism 30. The snowplow mechanism 30 may include a frame stricture 32, a first wing 34, and second wing 36. The particular snowplow mechanism 30 shown is known as a V-plow but it is to be understood that this invention will work with any snowplow mechanism that includes at least two wings that can be moved independently of each other. The frame 32 and thus the snowplow assembly 20 may attach to the vehicle 10 in any conventional manner chosen with sound engineering judgment.

Figure 3:
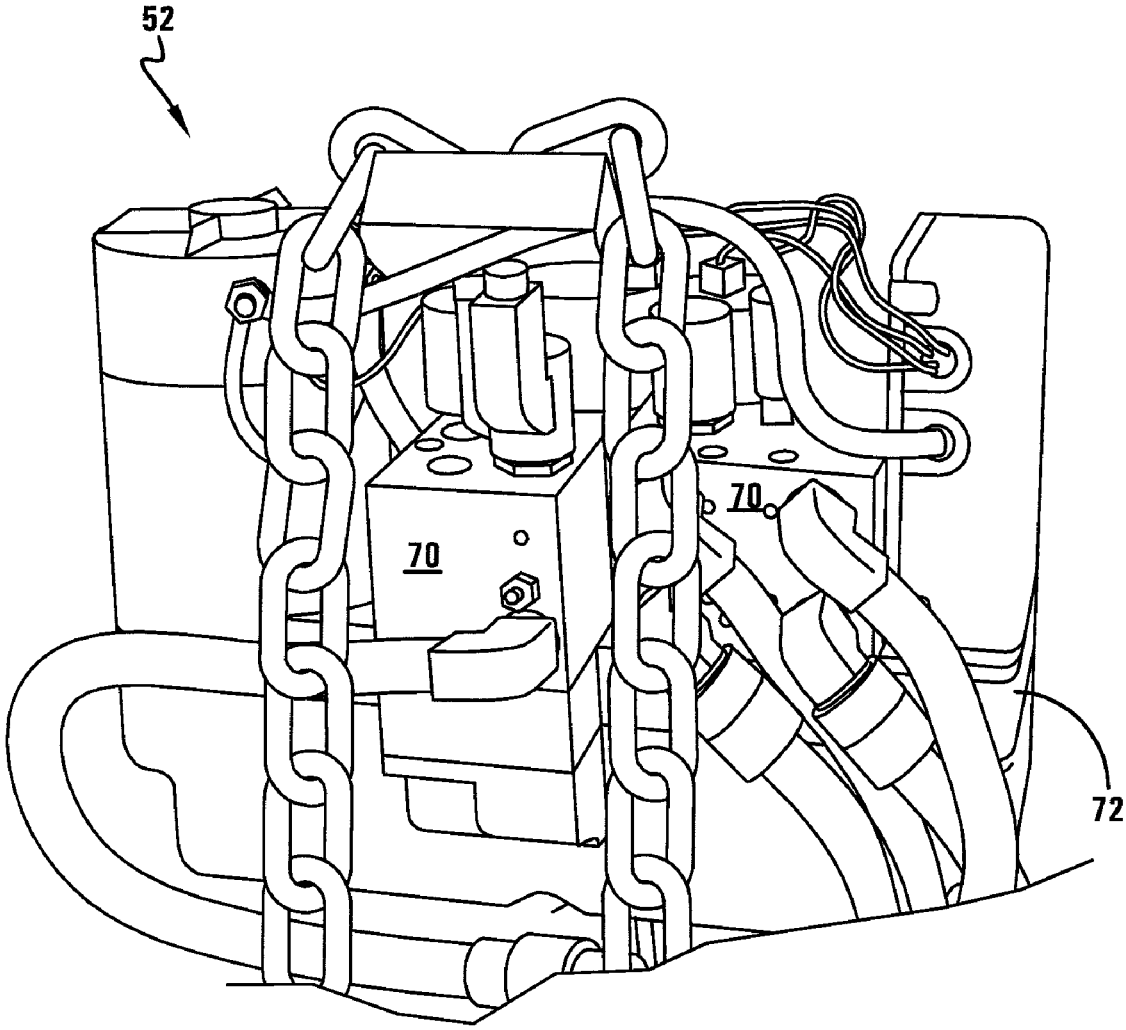
FIG. 3 is a perspective front view of a snowplow assembly hydraulic unit according to one embodiment of this invention.
Figure 4:
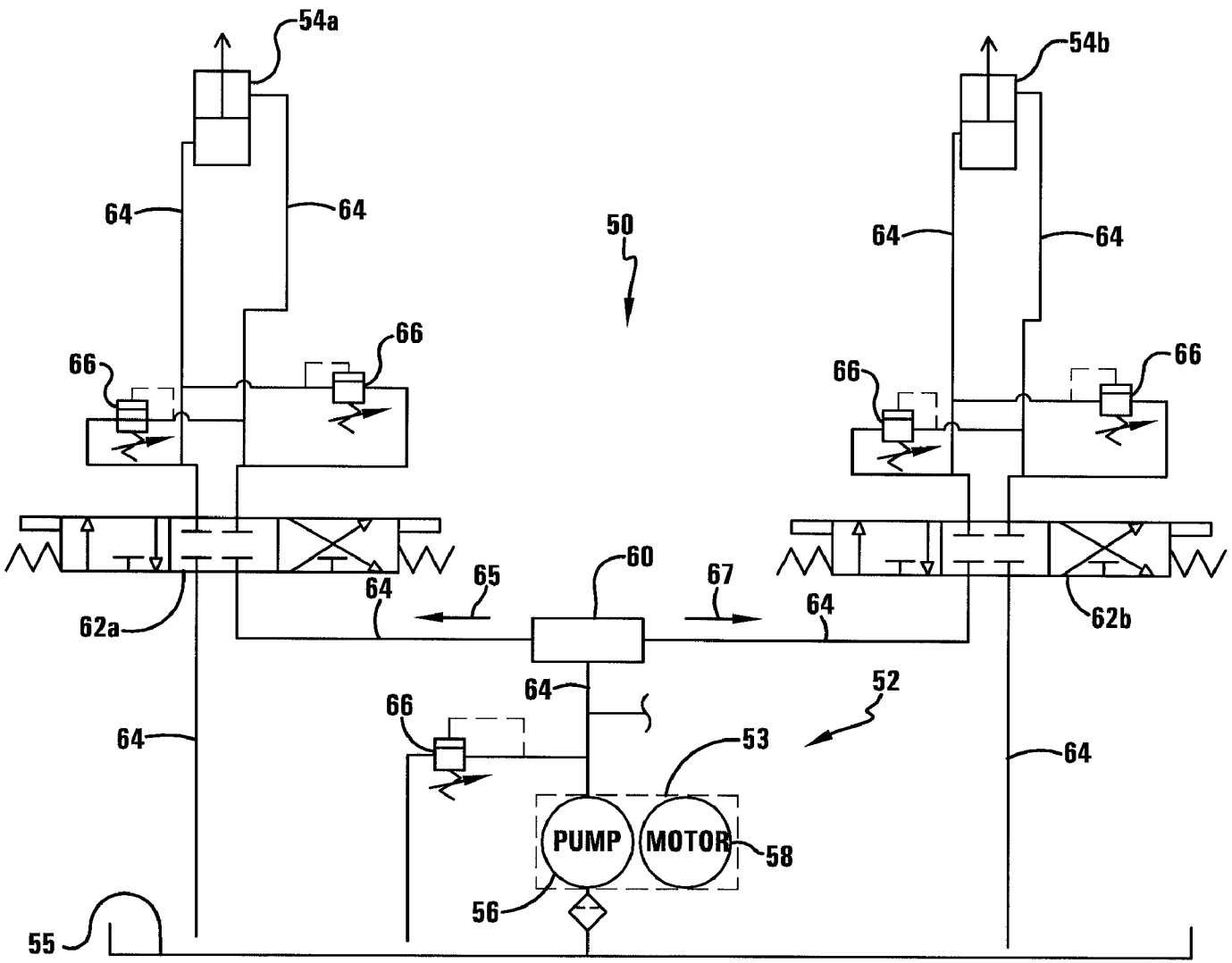
FIG. 4 is a schematic view of a snowplow assembly hydraulic system according to one embodiment of this invention.

With reference now to FIGS. 2-4, the hydraulic system 50 may include a hydraulic unit 52, one or more hydraulic cylinders 54, and hydraulic piping, hoses and fittings as may be required. The hydraulic unit 52 may be mounted to the frame 32, and may include a pump system 53. The pump system 53 may comprise a pump 56 and motor 58. The pump system 53 may cause the hydraulic fluid to move from a tank 55 and through the piping and hoses of the hydraulic system 50 as will be discussed further below. The hydraulic system 50 may be equipped to raise and lower the snowplow mechanism 30 relative to the surface being plowed and to move or pivot the snowplow mechanism 30 from side to side. These movements are well known in the art and thus will not be described in detail. Furthermore, these movements are not necessary with this invention although this invention will work well when these movements are provided.

With continuing reference to FIGS. 2-4, according to one embodiment of the invention, the hydraulic system 50 may include first and second cylinders 54*a*, 54*b* for use in independently pivoting the first wing 34 and the second wing 36, respectively, about a pivot axis 38. In one embodiment of the invention, the first wing 34 can be pivoted in either direction A or B and the second wing 36 can be pivoted in either direction C or D. Additionally, either the first wing 34 or the second wing 36 may remain in a fixed position while the other wing pivots about the pivot axis 38. All such pivoting motions are well know and will not be described in great detail. The plump system 53 may pump a hydraulic fluid to a first cylinder control valve 62*a* and to a second cylinder control valve 62*b*. The first cylinder control valve 62*a* may control the motion of the first wing 34 and the second cylinder control valve 62*b* may control the motion of the second wing 36. While each cylinder control valve 62*a*, 62*b* is shown to be a three-position solenoid valve, it is to be understood that any means of selectively communicating the hydraulic fluid to the first and second cylinders 54*a*, 54*b* chosen with sound engineering judgment will work well for this invention. Hydraulic piping and/or tubing 64 may connect the pump system 53 to the first and second cylinder control valves 62*a*, 62*b* and to the first and second cylinders 54*a*, 54*b*. Hydraulic piping 64 may also connect the first and second cylinders 54*a*, 54*b* to the first and second control valves 62*a*, 62*b* and to the tank 55. According to one embodiment of the invention, the hydraulic system 50 may comprise a plurality of relief valves 66 in case of an over pressure circumstance.

With continuing reference to FIGS. 2-4, according to one embodiment, the hydraulic system 50 may also include a flow divider 60. The pump system 53 may cause hydraulic fluid to be communicated from the tank 55 to the flow divider 60 via the hydraulic piping 64. In one embodiment, the flow divider 60 may receive the hydraulic fluid from the pump system 53 and may provide a first hydraulic stream 65 having a first flow rate to the first cylinder 54*a* via the first control valve 62*a* and a second hydraulic stream 67 having a second flow rate to the second cylinder 54*b* via the second control valve 62*b*. The first flow rate may be substantially the same as the second flow rate. By providing a first hydraulic stream 65 and a second hydraulic stream 67 with substantially the same flow rate, the flow divider 60 can cause the first and second wings 34, 36 to move at substantially the same time and substantially the same speed regardless of the disparity of loads acting on the first and second wings 34, 36.

With continuing reference to FIGS. 2-4, when the flow divider 60 is activated, movement of the first and second wings 34, 36 is even regardless of the differing loads that may be placed on them. The particular flow divider 60 used with this invention can be any chosen with sound engineering judgment. In one embodiment, the flow divider 60 may be a type known as a restrictive flow divider. In general, a restrictive flow divider restricts hydraulic fluid flow to the cylinder requiring the lower pressure (the cylinder operating the wing with the lesser load) and opens a free path of hydraulic fluid to the other cylinder (the cylinder operating the wing with the greater load). In another embodiment, the flow divider 60 may be a type known as a rotary flow divider. In general, a rotary flow divider is two (or more) fixed displacement pumps/motors coupled together. The hydraulic flow into the flow divider equals the flow out, which is divided in the ratio of the displacements of the pumps/motors. The operation of restrictive flow dividers and rotary flow dividers is known in the art and thus will not be discussed further.

With continuing reference to FIGS. 2-4, according to one embodiment, the hydraulic unit 52 may be modular and may include one or more hydraulic modules 70 that can be mounted to a base plate 72. Each hydraulic module 70 may include a manifold having one or more ports and one or more valves that may be mounted into the ports. Each hydraulic module 70 also may include a plurality of openings where corresponding hydraulic hoses can be attached to provide hydraulic fluid (and return) to the set of hydraulic components. The modularity of this embodiment of the hydraulic unit 52 may permit different combinations of hydraulic valves to be mounted to the same hydraulic module 70. The modularity of this invention also may permit different combinations of hydraulic modules 70 to be mounted to the same base plate 72. The tank 55 and hydraulic pump unit 56 may be sized to accommodate the maximum number of valves and hydraulic modules 70 that can be attached to the base plate 72. The general operation of this modular hydraulic unit 52 is described in co-pending U.S. patent application Ser. No. 60/657,565 which is incorporated herein by reference. The inventors contemplate that one option for the hydraulic unit 52 is to include a hydraulic module 70 that consists exclusively of or includes the flow divider 60 of this invention.

Figure 5:
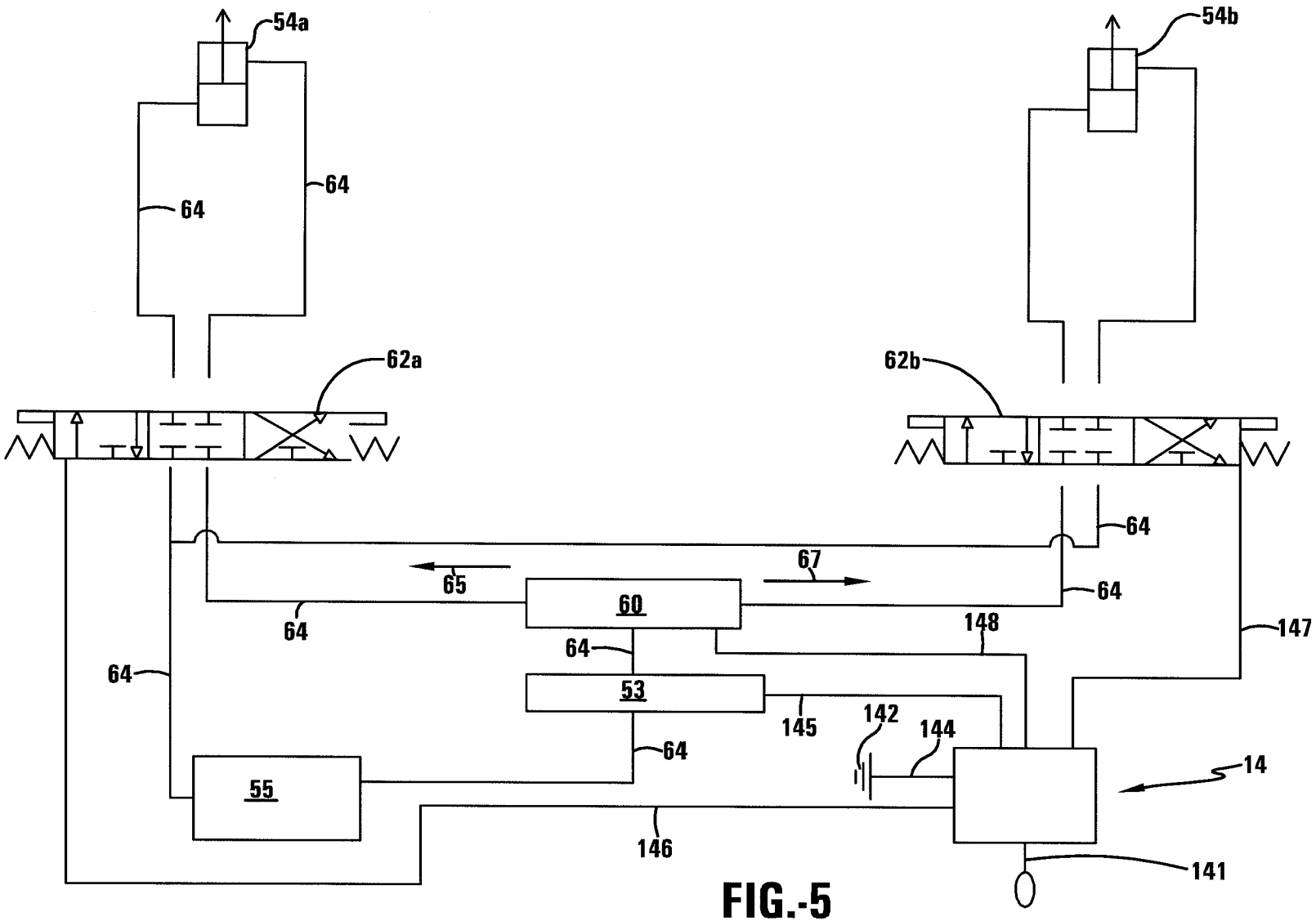
FIG. 5 is a schematic view of a snowplow assembly control and wiring system according to one embodiment of this invention.

With reference now to FIGS. 4-5, control of the first and second wings 34, 36 of the snowplow assembly 20 will be described. According to one embodiment of the invention, the control system 140 may comprise a microprocessor and associated control circuitry to control the flow of hydraulic fluid, and therefore, the movement of the snowplow assembly. In another embodiment of the invention, the control system 140 may comprise a controller 14 and a plurality of electrical wires 144, 145, 146, 147, and 148. The controller 14 may be primarily located within a single housing, as shown, or the controller 14 may include components positioned within one or more additional housings positioned near or apart from the shown housing. In one embodiment, the controller 14 may comprise a control device 141, for example, a lever or switch, and may be positioned within the occupant compartment 12 of the vehicle 10. The controller 14 may comprise any type of control device chosen with sound engineering judgment. The controller 14 may be fixedly attached to a portion of the vehicle 10, such as the dashboard (not shown). According to another embodiment, the controller 14 may be selectively attachable to a portion of the vehicle 10 such as with the use of a hook-and-loop fastener (VELCRO® is one example).

Figure 7:
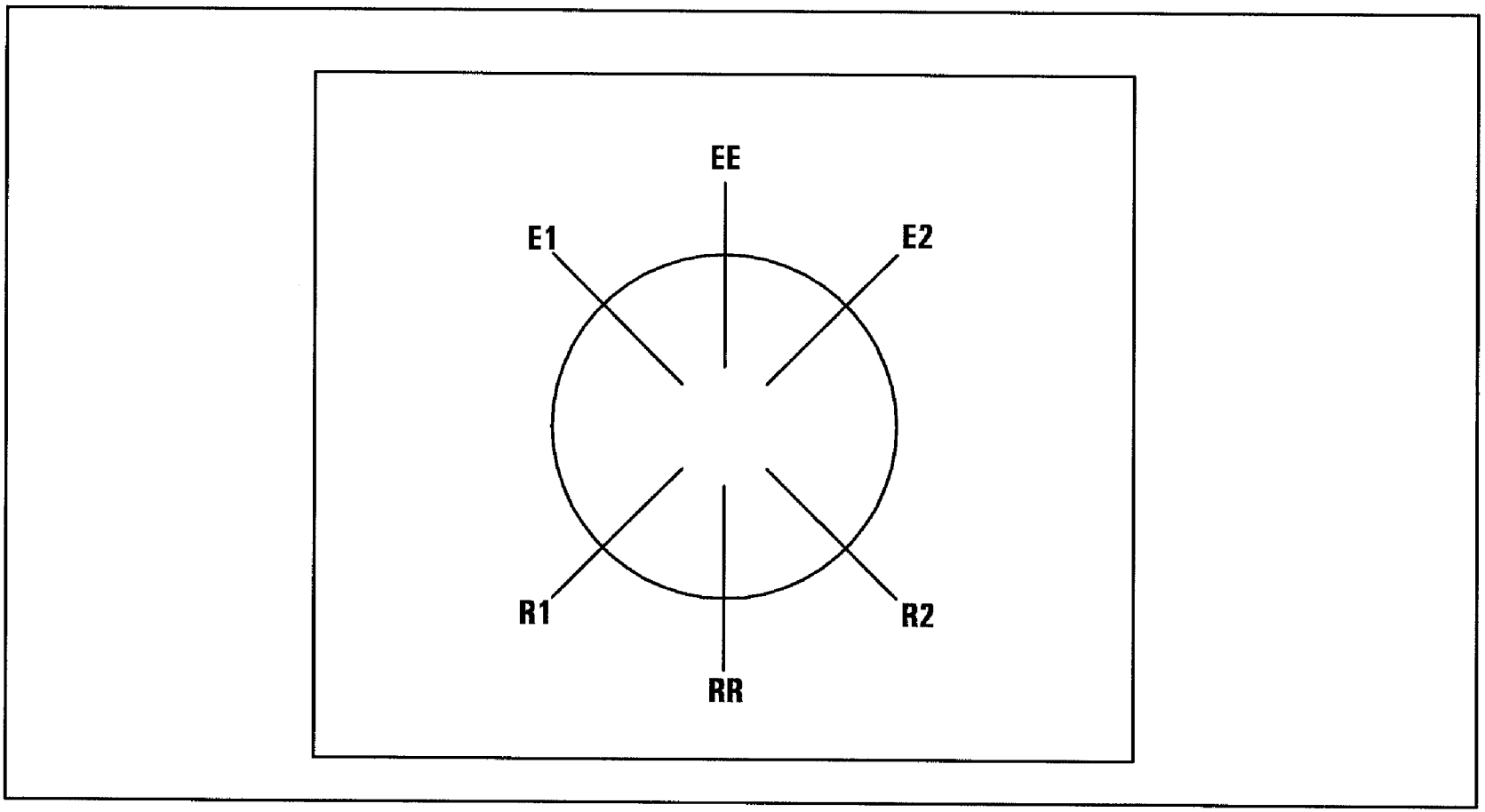
FIG. 7 is a partial schematic view of a snowplow assembly control showing various lever positions according to one embodiment of the invention.

With reference now to FIGS. 4-5, 7, in one embodiment of the invention, the controller 14 may be electrically connected to a battery 142 via the wire 144. The controller 14 may control the flow of hydraulic fluid, and therefore the movement of the snowplow assembly 20, by selectively communicating electrical energy to the pump system 53 and the solenoids located within the first and second cylinder control valves 62*a*, 62*b*. The controller 14 may be electrically connected to the pump system 53 via the wire 145. The controller 14 may be electrically connected to the first cylinder control valve 62*a* via the wire 146. The controller 14 may be electrically connected to the second cylinder control valve 62*b* via the wire 147. The controller 14 may be electrically connected to the flow divider 60 via the wire 148. The control device 141 may comprise a plurality of control positions, for example, H (for holding the wings in their current position), R1 (for retracting the first wing 34), E1 (for extending the first wing 34), R2 (for retracting the second wing 36), E2 (for extending the second wing 36), EE (for extending both the first and second wings 34, 36 substantially simultaneously), and RR (for retracting both the first and second wings 34, 36 substantially simultaneously). The controller 14 may comprise any number of control devices, for example, 2, and the control device 141 may comprise any control device positions chosen with sound engineering judgment.

With continued reference to FIGS. 4-5, according to one embodiment of the invention, placement of the control device 141 in control device position H may provide that neither the first or second cylinder control valves 62*a*, 62*b* to be energized, the flow divider 60 is not activated, and the motor 58 is not operating the pump 56. In control device position H both the first wing 34 and the second wing 36 may remain fixed in their current position. The placement of the control device 141 in control device position E1 may not cause the flow divider 60 to be activated, but may cause the motor 58 to operate the pump 56 and the first cylinder valve 62*a* to be energized in such a way that allows hydraulic fluid to enter the first cylinder 54*a* and thereby extend the first wing 34. The placement of the control device 141 in control device position R1 may not cause the flow divider 60 to be activated, but may cause the motor 58 to operate the pump 56 and the first cylinder valve 62*a* to be energized in such a way that allows hydraulic fluid to enter the first cylinder 54*a* and thereby retract the first wing 34. The placement of the control device 141 in control device position E2 may not cause the flow divider 60 to be activated, but may cause the motor 58 to operate the pump 56 and the second cylinder valve 62*b* to be energized in such a way that allows hydraulic fluid to enter the second cylinder 54*b* and thereby extend the second wing 36. The placement of the control device 141 in control device position R2 may not cause the flow divider 60 to be activated, but may cause the motor 58 to operate the pump 56 and the second cylinder valve 62*b* to be energized in such a way that allows hydraulic fluid to enter the second cylinder 54*b* and thereby retract the second wing 36.

With continued reference to FIGS. 4-5, the placement of the control device 141 in control device position EE may activate the flow divider 60, may cause the motor 58 to operate the pump 56, and may cause the first and second cylinder valves 62*a*, 62*b* to be energized in such a way that allows hydraulic fluid to enter the first and the second cylinders 54*a*, 54*b* and thereby extend the first and second wings 34, 36. Upon activation, the flow divider 60 may provide the first hydraulic stream 65 and the second hydraulic stream 67. The first hydraulic stream 65 and the second hydraulic stream 67 may have substantially the same flow rate as described above. The placement of the control device 141 in control device position RR may activate the flow divider 60, may cause the motor 58 to operate the pump 56, and may cause the first and second cylinder valves 62*a*, 62*b* to be energized in such a way that allows hydraulic fluid to enter the first and the second cylinder 54*a*, 54*b* and thereby retract the first and second wings 34, 36. Upon activation, the flow divider 60 may provide the first hydraulic stream 65 and the second hydraulic stream 67. The first hydraulic stream 65 and the second hydraulic stream 67 may also have substantially the same flow rate as described above.

Figure 6:
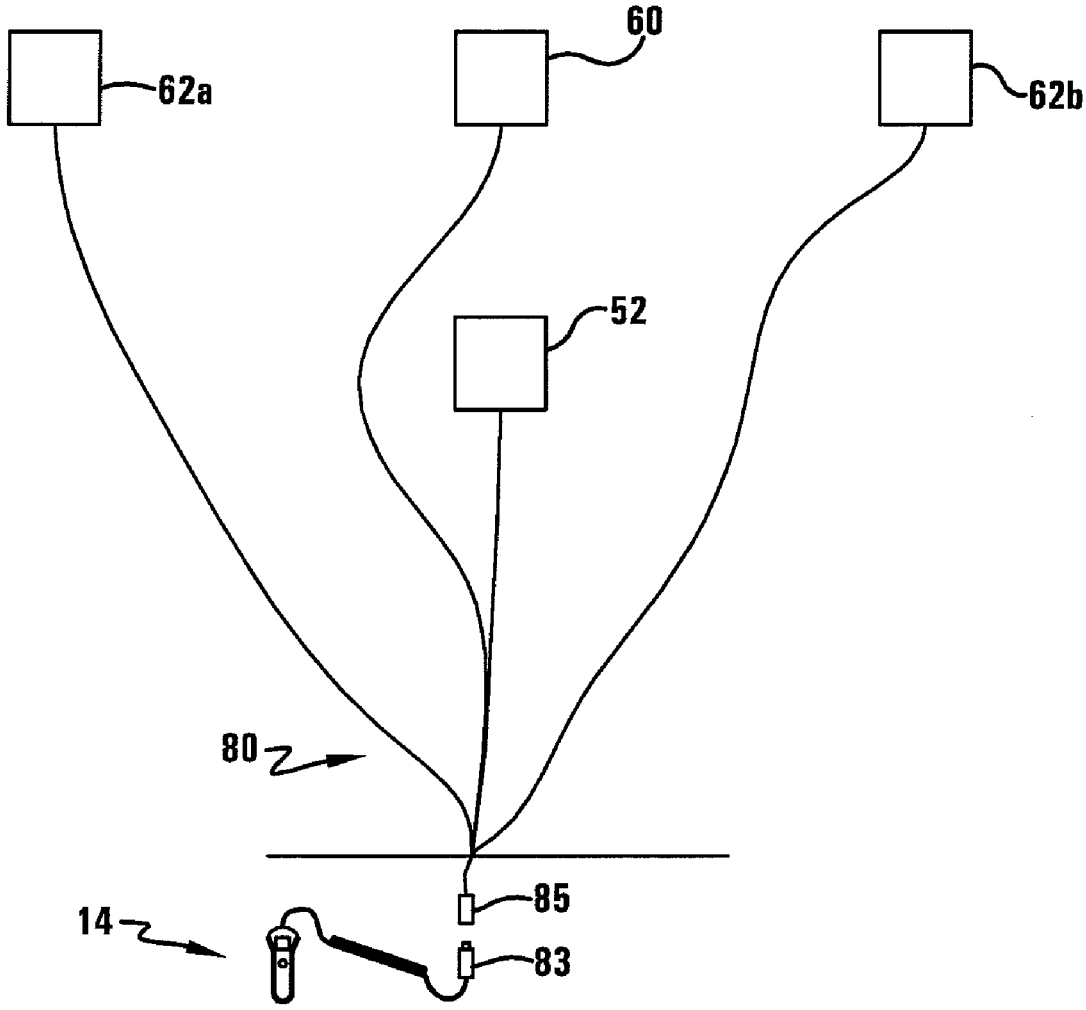
FIG. 6 is a schematic view of a snowplow assembly control and wiring system according to another embodiment of this invention.

With reference now to FIG. 6, according to another embodiment of the invention, the controller 14 may be selectively attached to a communication link 80 that communicates with the other snowplow assembly components. The communication link 80 may include a pair of plugs 83, 85 that selectively engage each other to complete an electrical connection. With this embodiment, the controller 14 may be a handheld controller 14 that can be easily moved within the occupant compartment 12 to any position comfortable for the operator. In yet another embodiment, the controller 14 is not hard wired to the snowplow assembly 20, but may incorporate, for example, radio frequency control. Such radio frequency control is known in the art and, thus, will not be described here. The controller 14 may be used in any known manner to control the hydraulic unit 52 (including the flow divider 60), the first cylinder control valve 62*a*, and the second cylinder control valve 62*b*. In this way motion of the first and second wings 34, 36 (as well as other motions of the snowplow assembly 20) can be controlled by the operator.

Various embodiments have been described, hereinabove. It will be apparent to those skilled in the art that the above methods and apparatuses may incorporate changes and modifications without departing from the general scope of this invention. It is intended to include an such modifications and alterations in so far as they come within the scope of the appended claims or the equivalents thereof.

What is claimed is:

1. A snowplow assembly comprising:

a snowplow mechanism comprising:

a frame;

a first wing and a second wing that are adapted to move independently with respect to the frame;

a hydraulic system comprising:

a first cylinder for use in moving the first wing;

a second cylinder for use in moving the second wing;

a pump system for use in providing hydraulic fluid to the first and second cylinders, and, a flow divider that causes the first wing and the second wing to move at substantially the same time and substantially the same speed regardless of the disparity of loads on the first wing and the second wing; and, a control system for use in controlling the hydraulic system.

2. The snowplow assembly of claim 1 wherein the flow divider receives hydraulic fluid from the pump system and provides a first hydraulic stream having a first flow rate to the first cylinder and a second hydraulic stream having a second flow rate to the second cylinder, the first flow rate being substantially the same as the second flow rate.

3. The snowplow assembly of claim 1 wherein the first wing and the second wing are adapted to pivot independently with respect to the frame.

4. The snowplow assembly of claim 1 wherein the flow divider is a restrictive flow divider.

5. The snowplow assembly of claim 1 wherein the flow divider is a rotary flow divider.

6. The snowplow assembly of claim 1, wherein the control system comprises:

a control device that can be placed into a control device position for use in moving the first wing and the second wing at substantially the same time and substantially the same speed.

7. The snowplow assembly of claim 6, wherein the control device comprises a lever.

8. The snowplow assembly of claim 6, wherein the control device comprises a switch.

9. The snowplow assembly of claim 1, wherein the control system comprises:

a plurality of control devices that can be placed into a plurality of control device positions for use in moving the first wing and the second wing.

10. A method comprising the steps of:

providing a snowplow mechanism comprising: a frame; a first wing, and a second wing, wherein the first wing and the second wing are adapted to move independently with respect to the frame;

providing a hydraulic system comprising: a first cylinder for use in moving the first wing; a second cylinder for use in moving the second wing; a pump system for use in providing hydraulic fluid to the first and second cylinders; and, a flow divider;

applying a first load to the first wing;

applying a second load to the second wing, wherein the first load is greater than the second load; and, moving the first wing and the second wing at substantially the same time and substantially the same speed.

11. The method of claim 10 wherein the step of, moving the first wing and the second wing at substantially the same time and substantially the same speed, further comprises the step of:

pivoting the first wing and the second wing at substantially the same time and substantially the same speed.

12. The method of claim 10 wherein the step of, moving the first wing and the second wing at substantially the same time and substantially the same speed, further comprises the steps of:

communicating hydraulic fluid from the pump system to the fluid divider;

communicating a first hydraulic stream having a first flow rate from the fluid divider to the first cylinder; and, communicating a second hydraulic stream having a second flow rate from the fluid divider to the second cylinder, wherein the first flow rate is substantially the same as the second flow rate.

13. The method of claim 10, wherein the step of, moving the first wing and the second wing at substantially the same time and substantially the same speed, further comprises the steps of:

providing a control system, wherein the control system comprises a control device;

positioning the control device in a control device position for moving the first wing and the second wing at substantially the same time and substantially the same speed;

communicating hydraulic fluid from the pump system to the fluid divider;

communicating a first hydraulic stream having a first flow rate from the fluid divider to the first cylinder; and, communicating a second hydraulic stream having a second flow rate from the fluid divider to the second cylinder wherein the first flow rate is substantially the same as the second flow rate.

* * * * *